US009606491B2

(12) United States Patent
Miwa et al.

(10) Patent No.: US 9,606,491 B2
(45) Date of Patent: Mar. 28, 2017

(54) IMAGE FORMING APPARATUS

(71) Applicant: Brother Kogyo Kabushiki Kaisha, Nagoya-shi, Aichi-ken (JP)

(72) Inventors: Atsushi Miwa, Anjo (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/926,094

(22) Filed: Oct. 29, 2015

(65) Prior Publication Data

US 2016/0124370 A1 May 5, 2016

(30) Foreign Application Priority Data

Oct. 31, 2014 (JP) ..... 2014-223000

(51) Int. Cl.

| | |
|---|---|
| ***G03G 15/23*** | (2006.01) |
| ***G03G 15/00*** | (2006.01) |
| ***B65H 5/06*** | (2006.01) |
| ***B65H 5/36*** | (2006.01) |
| ***B65H 9/00*** | (2006.01) |

(Continued)

(52) U.S. Cl.

CPC ..... *G03G 15/6552* (2013.01); *B65H 5/062* (2013.01); *B65H 5/36* (2013.01); *B65H 9/002* (2013.01); *B65H 29/125* (2013.01); *B65H 85/00* (2013.01); *G03G 15/234* (2013.01); *B65H 2301/33312* (2013.01); *B65H 2402/45* (2013.01); *B65H 2405/1117* (2013.01); *B65H 2405/11151* (2013.01); *B65H 2601/324* (2013.01)

(58) Field of Classification Search

CPC .... G03G 15/00; G03G 15/65; G03G 15/6529; G03G 15/6552; G03G 15/6579

See application file for complete search history.

(56) References Cited

U.S. PATENT DOCUMENTS

| | | | | |
|---|---|---|---|---|
| 8,346,153 | B2 | 1/2013 | Ogawa | |
| 2003/0175060 | A1* | 9/2003 | Suzuki | G03G 15/231 399/401 |

(Continued)

FOREIGN PATENT DOCUMENTS

| | | | |
|---|---|---|---|
| JP | 2007-022687 | A | 2/2007 |
| JP | 2009-058740 | A | 3/2009 |
| JP | 2009-263103 | A | 11/2009 |

*Primary Examiner* — David Banh

(74) *Attorney, Agent, or Firm* — Banner & Witcoff, Ltd.

(57) ABSTRACT

An image forming apparatus includes: an electrophotographic image forming section; a sheet feeding tray; a conveying roller; a sheet discharging tray; a sheet discharging roller that is switched between a first state in which the sheet discharging roller rotates in a first direction and a second state in which the sheet discharging roller rotates in a second direction in which the sheet is conveyed back toward the image forming section; and a re-conveying roller that conveys the sheet conveyed back toward the image forming section by the sheet discharging roller, the re-conveying roller having an axial direction parallel to an axial direction of the conveying roller and being located at a position at which the re-conveying roller projected onto a first virtual plane that is perpendicular to the axial direction at least partially overlap with the conveying roller projected onto the first virtual plane.

11 Claims, 8 Drawing Sheets

(51) Int. Cl.
*B65H 29/12* (2006.01)
*B65H 85/00* (2006.01)

(56) References Cited

U.S. PATENT DOCUMENTS

| | | | | |
|---|---|---|---|---|
| 2008/0159793 | A1* | 7/2008 | Park | G03G 15/6576 399/374 |
| 2009/0060568 | A1 | 3/2009 | Ishikawa et al. | |
| 2009/0087237 | A1* | 4/2009 | Sato | G03G 15/234 399/381 |
| 2009/0269113 | A1 | 10/2009 | Ogawa | |
| 2010/0296856 | A1* | 11/2010 | Moriyama | B41J 3/60 400/642 |
| 2011/0236096 | A1* | 9/2011 | Miwa | G03G 15/234 399/364 |
| 2014/0321897 | A1* | 10/2014 | Ogata | G03G 15/602 399/373 |
| 2016/0124380 | A1* | 5/2016 | Miwa | G03G 21/1619 399/107 |

* cited by examiner

IMAGE FORMING APPARATUS

CROSS-REFERENCE TO RELATED APPLICATION

This application claims priorities from Japanese Patent Application No. 2014-223000 filed on Oct. 31, 2014, the entire subject matters of which is incorporated herein by reference.

TECHNICAL FIELD

The present disclosure relates to an image forming apparatus that is capable to form an image (which includes characters) on both front and back surfaces of a sheet.

BACKGROUND

An image forming apparatus that is capable to form an image on both front and back surfaces of a sheet has a function of switching back a conveying direction of a sheet in which an image is formed on one surface thereof and sending the sheet to an image forming section again.

In the image forming apparatus that is capable to form an image on both front and back surfaces of a sheet, a conveying path for sending a sheet in which an image is formed on one surface thereof to the image forming section again may be required. Accordingly, the external dimension of the image forming apparatus is likely to increase. However, a further decrease in external dimension is required for the image forming apparatus.

SUMMARY

The present disclosure has been made in view of the above circumstances, and one of objects of the present disclosure is to provide a an image forming apparatus that has a function of switching back a conveying direction of a sheet in which an image has been formed on one surface thereof and sending the sheet to an image forming section again, that is capable to form an image on both front and back surfaces of a sheet, with a configuration that allows to have smaller external dimension.

According to an illustrative embodiment of the present disclosure, there is provided an image forming apparatus including: an electrophotographic image forming section that forms an image on a sheet; a sheet feeding tray on which a sheet to be conveyed to the image forming section is placed; a conveying roller that conveys the sheet to the image forming section; a sheet discharging tray to which the sheet being formed with an image by the image forming section is discharged; a sheet discharging roller that is switched between a first state in which the sheet discharging roller rotates in a first direction in which the sheet is discharged to the sheet discharging tray and a second state in which the sheet discharging roller rotates in a second direction in which the sheet is conveyed back toward the image forming section; and a re-conveying roller that conveys the sheet conveyed back toward the image forming section by the sheet discharging roller, the re-conveying roller having an axial direction parallel to an axial direction of the conveying roller and being located at a position at which the re-conveying roller projected onto a first virtual plane that is perpendicular to the axial direction at least partially overlap with the conveying roller projected onto the first virtual plane.

DETAILED DESCRIPTION

Figure 1:
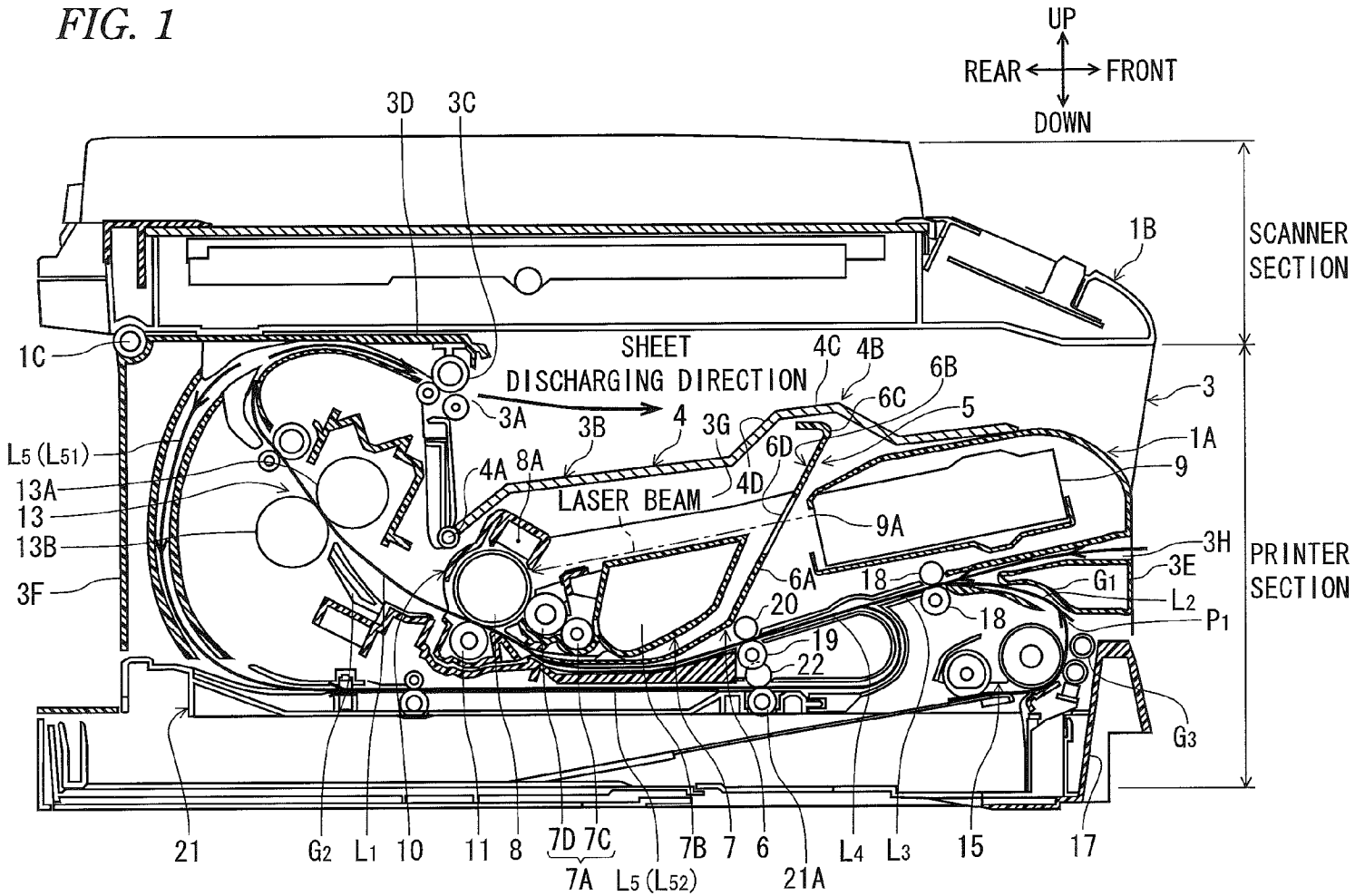
FIG. 1 is a central cross-sectional view of an image forming apparatus according to an embodiment of the present disclosure.

"Embodiments of the disclosure" to be described below are examples of the embodiments. That is, specific items described in the appended claims are not limited to specific means or structures described in the following embodiments.

In the embodiments, a sheet conveying unit according to the present disclosure is applied to a monochrome image forming apparatus. Hereinafter, the embodiments of the present disclosure will be described with reference to the accompanying drawings.

Arrows indicating directions are illustrated in the drawings to help easily understand the relationships between the drawings, and the present disclosure is not limited to the directions illustrated in the drawings. The numbers of members or portions referenced by reference numerals are at least one, unless "plural" or "two or more" is mentioned.

In an image forming apparatus 1 according to an embodiment of the present disclosure, a printer section 1A and a scanner section 1B are combined in a single body. The printer section 1A is serves as a printer that forms an image on a sheet such as a paper sheet. The scanner section 1B serves an image scanner that scans an image, which may include characters, on an original document.

The scanner section 1B is disposed on the upper side of the printer section 1A in the vertical direction. On the lower side of the scanner section 1B in the vertical direction, a sheet discharging tray 3B on which a sheet completely subjected to formation of an image is placed is disposed.

The scanner section 1B is pivotably connected to the printer section 1A via a hinge portion 1C. The hinge portion 1C is formed on the upper side of the printer section 1A in the vertical direction and on the rear side of the printer section 1A.

The rear side of the printer section 1A means a side opposite to a front side when a leading side in a discharging direction of a sheet discharged to the sheet discharging tray 3B is defined as the front side. The right side in FIG. 1 is defined as the front side of the printer section 1A. The left side in FIG. 1 is defined as a rear side of the printer section 1A.

An image forming section 5 that forms an image on a sheet is received in a case 3 of the printer section 1A. A sheet discharging port 3A and a sheet discharging tray 3B are disposed in the upper portion of the case 3 in the vertical direction. The sheet discharging port 3A is an opening through which the sheet having an image formed thereon is discharged.

A sheet discharged from the sheet discharging port 3A is placed on the sheet discharging tray 3B. A sheet discharging roller 3C that discharges a sheet to the sheet discharging tray 3B is disposed in the sheet discharging port 3A. The sheet discharging roller 3C can be switched between a state in which the discharged sheet is sent to the sheet discharging tray 3B and a state in which the conveying direction of the sheet is reversed and the sheet is re-conveyed to the image forming section 5.

That is, the sheet discharging roller 3C can be switched between a state in which the sheet discharging roller rotates in a direction in which the sheet is sent to the sheet discharging tray 3B and a state in which the sheet discharging roller rotates in a direction in which the sheet is switched back and the sheet is sent to the image forming section 5 again.

The case 3 includes a top cover 3D, a pair of side covers (not illustrated), a front cover 3E, and a rear cover 3F. The top cover 3D covers the top surface in the vertical direction of the printer section 1A. The side covers cover the right side surface and the left side surface of the printer section 1A to form an external design surface of the printer section 1A.

The front cover 3E covers the front surface of the printer section 1A to form the external design surface of the printer section 1A. The rear cover 3F covers the rear surface of the printer section 1A to form the external design surface of the printer section 1A.

A manual feeding port 3H is formed in the front cover 3E. The manual feeding port 3H is an opening for directly feeding a sheet to the image forming section 5 without using a feeder mechanism 15 to be described later.

The image forming section 5 employs an electrophotographic system in which a developer is transferred to a sheet. As illustrated in FIG. 1, the image forming section 5 includes an image forming unit 6, an exposure device 9, a transfer unit 11, and a fixing device 13.

The image forming unit 6 is detachably attached to an apparatus body via an opening 3G. The opening 3G is a through-hole formed in the case 3. In this embodiment, the opening 3G is formed in the upper surface in the vertical direction of the case 3, that is, the top cover 3D, and is opened to the upside in the vertical direction.

The apparatus body means a part which is not disassembled by a user, such as the case 3 or a frame (not illustrated). The frame is formed of plate-like members disposed on both sides in the horizontal direction with the image forming section 5 interposed therebetween. The units constituting the image forming section 5 are attached to the frame.

The opening 3G is closed by an intermediate cover 4. The intermediate cover 4 can be displaced between a closed position at which the opening 3G is closed and an opened position at which the opening 3G is opened. The sheet discharging tray 3B is disposed on the top surface of the intermediate cover 4. That is, when the intermediate cover 4 is located at the closed position, the intermediate cover 4 serves as the sheet discharging tray 3B.

The opening 3G is located at a position in the case 3 (top cover 3D) which corresponds to the position of the sheet discharging tray 3B, that is, the position of the intermediate cover 4 at the closed position. Accordingly, in this embodiment, the position of the opening 3G corresponds to a placement surface other than a protruding lid 4B of the sheet discharging tray 3B as indicated by a two-dot chained line in FIG. 2.

The intermediate cover 4 according to this embodiment is displaceably connected to the top cover 3D via a hinge portion 4A. The hinge portion 4A is disposed on the sheet discharging port 3A side of the intermediate cover 4, that is, at the rear end of the intermediate cover 4.

Figure 2:
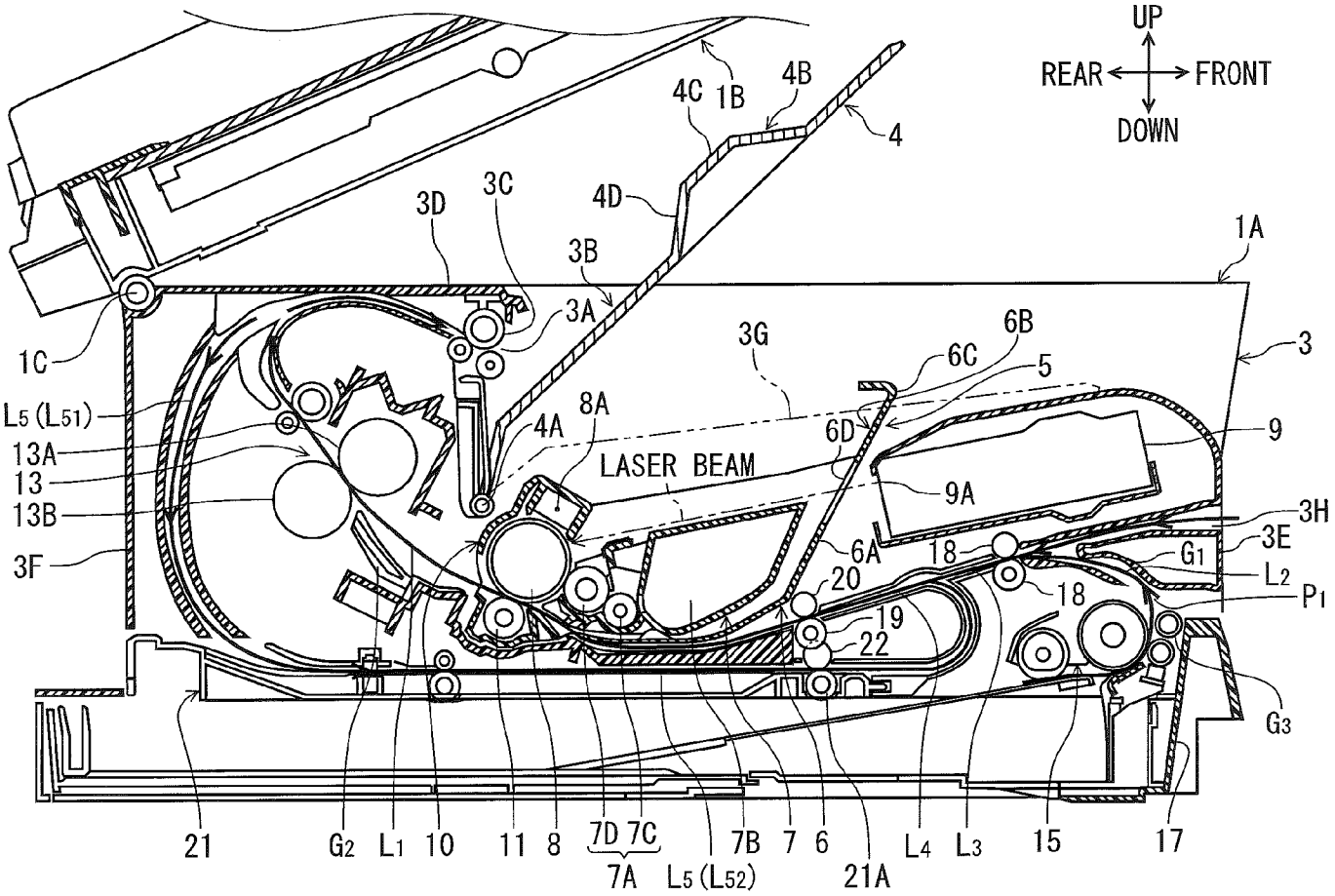
FIG. 2 is a central cross-sectional view of the image forming apparatus according to the embodiment of the present disclosure.

When a user attaches or detaches the image forming unit 6, the user pivots the scanner section 1B to the upper side in the vertical direction and then switches the intermediate cover 4 to the opened position as illustrated in FIG. 2. Accordingly, the image forming unit 6 received in the case 3 can pass through the opening 3G.

In the image forming unit 6, a container unit 7, a drum unit 10, and other components are arranged as a unified body along with a support member 6A as illustrated in FIG. 1. The container unit 7 is detachably attached to the support member 6A. The drum unit 10 is incorporated into the support member 6A so as not to be detachable from the support member 6A.

The container unit 7 includes a developing device 7A and a container portion 7B. The developing device 7A supplies a developer contained in the container portion 7B to a photosensitive drum 8. The developing device 7A includes a developing roller 7D and a supply roller 7E. The drum unit 10 includes the photosensitive drum 8 and a charger 8A.

That is, the image forming unit 6 includes the photosensitive drum 8, the charger 8A, the developing device 7A, and the container portion 7B. Accordingly, when the intermediate cover 4 is located at the opened position, the image forming unit 6 can be attached to and detached from the apparatus body and the container unit 7 can be attached to and detached from the support member 6A (the image forming unit 6) and the drum unit 10.

The photosensitive drum 8 is a photosensitive member that holds a developer image. The charger 8A charges the photosensitive drum 8. The exposure device 9 exposes the charged photosensitive drum 8. Accordingly, an electrostatic latent image is formed on the photosensitive drum 8. In this embodiment, the exposure device 9 exposes the photosensitive drum 8 while applying a laser beam.

When the developer is supplied to the photosensitive drum 8 having the electrostatic latent image thereon, a developer image is formed on the photosensitive drum 8. The transfer unit 11 is disposed at a position facing the photosensitive drum 8. The transfer unit 11 transfers the developer image held on the photosensitive drum 8 to a sheet.

The fixing device 13 fixes the developer image, which has been transferred to the sheet, to the sheet. The sheet discharged from the fixing device 13 is conveyed to the sheet discharging roller 3C. The fixing device 13 includes a heating roller 13A that comes in contact with the sheet and heats the developer and a pressure roller 13B that presses the sheet against the heating roller 13A.

A contact part of the fixing device 13 and the sheet, that is, a sheet nipping point between the heating roller 13A and the pressure roller 13B, is located above a contact part of the photosensitive drum 8 and the sheet in the vertical direction.

Accordingly, a sheet conveying path L1 extending from the photosensitive drum 8 to the fixing device 13 is inclined with respect to the horizontal direction. The sheet conveying path L1 includes at least a second conveyance guide portion G2.

A feeder mechanism 15 is disposed upstream in the sheet conveying direction from the image forming section 5. The feeder mechanism 15 sends out sheets placed on a sheet feeding tray 17 to the image forming section 5 one by one. The sheet feeding tray 17 is detachably attached to the apparatus body below the image forming unit 6 in the vertical direction in the apparatus body.

In this embodiment, the image forming unit 6 and the exposure device 9 are located below the sheet discharging tray 3B (the intermediate cover 4) in the vertical direction and above the sheet feeding tray 17 in the vertical direction, and the exposure device 9 and the image forming unit 6 are sequentially arranged in this order from the front side. Specifically, the exposure device 9, the container portion 7B, the developing device 7A, the photosensitive drum 8, and the fixing device 13 are sequentially arranged in this order from the front side.

A sheet sent out from the sheet feeding tray 17 is guided to the photosensitive drum 8 via a U-shaped conveying path L2 which is substantially curved in a U shape. A first conveyance guide portion G1 constituting at least a part of the U-shaped conveying path L2 turns the conveying direction of the sheet in a U shape.

In this embodiment, the conveying direction of the sheet sent out by the feeder mechanism 15 is turned by about 180 degrees by a guide roller G3 and the first conveyance guide portion G1. Hereinafter, a part of the U-shaped conveying path L2 in which the conveying direction corresponds to the vertical direction is referred to as a "turning apex P1."

An inclined path 4 is formed in a post-turning conveying path L3 of the U-shaped conveying path L2. The post-turning conveying path L3 is a part of the U-shaped conveying path L2 in which a lead side in the conveying direction is directed to the photosensitive drum 8. The inclined path 4 is a conveying path of the post-turning conveying path L3 in which it goes down in the vertical direction toward the photosensitive drum 8.

The U-shaped conveying path L2 is provided with a pair of first conveying rollers 18 and second conveying rollers 19 and 20. The conveying rollers 18 to 20 convey the sheet to the image forming unit 6, that is, the image forming section 5.

A pair of first conveying rollers 18 is disposed in a merging portion of the conveying path extending from the manual feeding port 3H to the inclined path 4H and the U-shaped conveying path L2. The second conveying rollers 19 and 20 are disposed in the inclined path 4.

The second conveying rollers 19 and 20 are disposed upstream in the conveying direction from the image forming unit 6 (the photosensitive drum 8) and serves as a part of a correcting mechanism that corrects a position of the sheet conveyed to the photosensitive drum 8. Accordingly, the second conveying rollers 19 and 20 are also referred to as "registration rollers."

Figure 3:
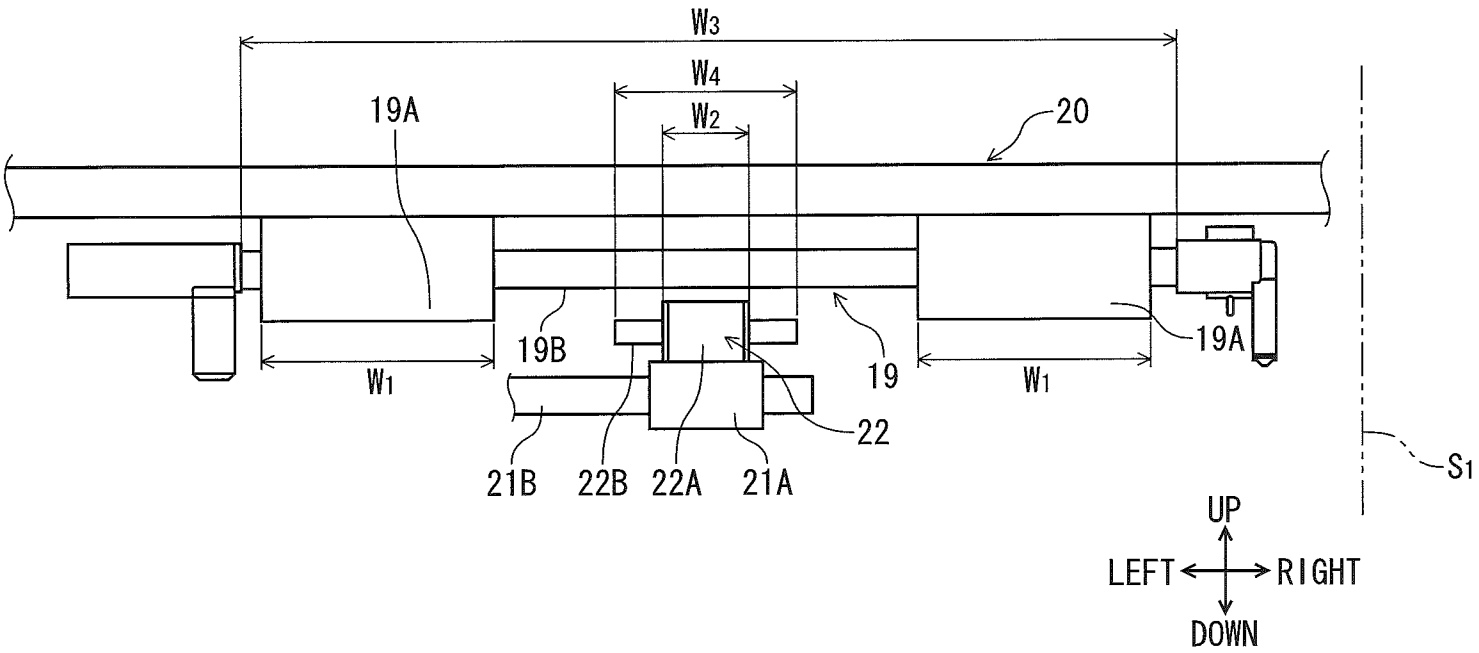
FIG. 3 is a diagram illustrating a registration driving roller, a re-conveying roller, and other components which are projected onto a second virtual plane.

As illustrated in FIG. 3, the second conveying roller 19 includes at least one (two in this embodiment) conveying roller portion 19A and a conveying roller shaft 19B that supports the conveying roller portion 19A.

The diameter of the conveying roller shaft 19B is smaller than the diameter of the conveying roller portion 19A. The size W1 in the axial direction of the conveying roller portion 19A is smaller than the size W3 in the axial direction of the conveying roller shaft 19B.

The conveying roller portion 19A is a part that comes in contact with a sheet and rotates, and is formed of a material having a relatively large friction coefficient with the sheet, such as rubber. A driving force is intermittently transmitted to the conveying roller shaft 19B. That is, the second conveying roller 19 is a driving conveying roller that gives a conveying force to the sheet. Hereinafter, the second conveying roller 19 is also referred to as a registration driving roller 19.

The second conveying roller 20 is a follower roller that rotates to follow the conveyance of the conveyed sheet and the diameter thereof is constant over the entire range in the length direction (axial direction). Hereinafter, the second conveying roller 20 is also referred to as a registration pinch roller 20.

The correction of the sheet position is performed as follows. That is, when or just before the tip in the conveying direction of the sheet reaches the registration driving roller 19, the transmission of the driving force to the registration driving roller 19 is intercepted.

Accordingly, the position of the sheet is corrected such that the tip in the conveying direction of the sheet moves along the outer circumferential surface of the registration pinch roller 20. When a predetermined time elapses after the registration driving roller 19 is stopped, the transmission of the driving force to the registration driving roller 19 is restarted.

The image forming apparatus 1 according to this embodiment forms images on both front and back surfaces of a sheet by re-conveying a sheet having an image formed on one surface thereof to the image forming section 5 (the image forming unit 6) again.

As illustrated in FIG. 1, the sheet of which the conveying direction is reversely turned (switched back) by the sheet discharging roller 3C is re-conveyed to the image forming section 5 (the image forming unit 6) via a re-conveying path L5.

The re-conveying path L5 includes a first re-conveying path L51 and a second re-conveying path L52. The first re-conveying path L51 turns the sheet, of which the conveying direction is turned to the rear side by the sheet discharging roller 3C, to the lower side in the vertical direction and then turns the conveying direction thereof to the front side.

The second re-conveying path L52 conveys the sheet, which is conveyed via the first re-conveying path L51, from the rear side to the front side and then merges the sheet with the post-turning conveying path L3. That is, the sheet conveyed through the second re-conveying path L52 reaches the image forming section 5 (the image forming unit 6) via at least a part of the post-turning conveying path L3.

The second re-conveying path L52 includes a re-conveying unit 21. The re-conveying unit 21 is detachably attached to a part of the apparatus body (in the case 3) below the image forming section 5 (the image forming unit 6) in the vertical direction and above the sheet feeding tray 17 in the vertical direction.

A re-conveying roller 22 that conveys a sheet is disposed in the second re-conveying path L52. The axial direction of the re-conveying roller 22 is parallel to the axial direction of the registration driving roller 19 (the conveying roller shaft 19B) as illustrated in FIG. 3.

The re-conveying roller 22 includes at least one (one in this embodiment) re-conveying roller portion 22A and a re-conveying roller shaft 22B supporting the re-conveying roller portion 22A. The re-conveying roller portion 22A is a part that rotates while coming in contact with the sheet conveyed through the second re-conveying path L52.

The diameter of the re-conveying roller shaft 22B is smaller than the diameter of the re-conveying roller portion 22A. The size W2 in the axial direction of the re-conveying roller portion 22A is smaller than the size W4 in the axial direction of the re-conveying roller shaft 22B.

The conveying roller portions 19A is displaced in the axial direction from the re-conveying roller portion 22A. The registration driving roller 19 (the conveying roller portion 19A) projected onto the first virtual plane S1 perpendicular to the axial direction of the registration driving roller 19 and the re-conveying roller 22 projected onto the first virtual plane overlap with each other at least partially as illustrated in FIG. 4.

The conveying roller portions 19A projected onto the second virtual plane S2 perpendicular to the first virtual plane S1 are located on both sides of the re-conveying roller portion 22A projected onto the second virtual plane S2 as illustrated in FIG. 3.

Figure 4:
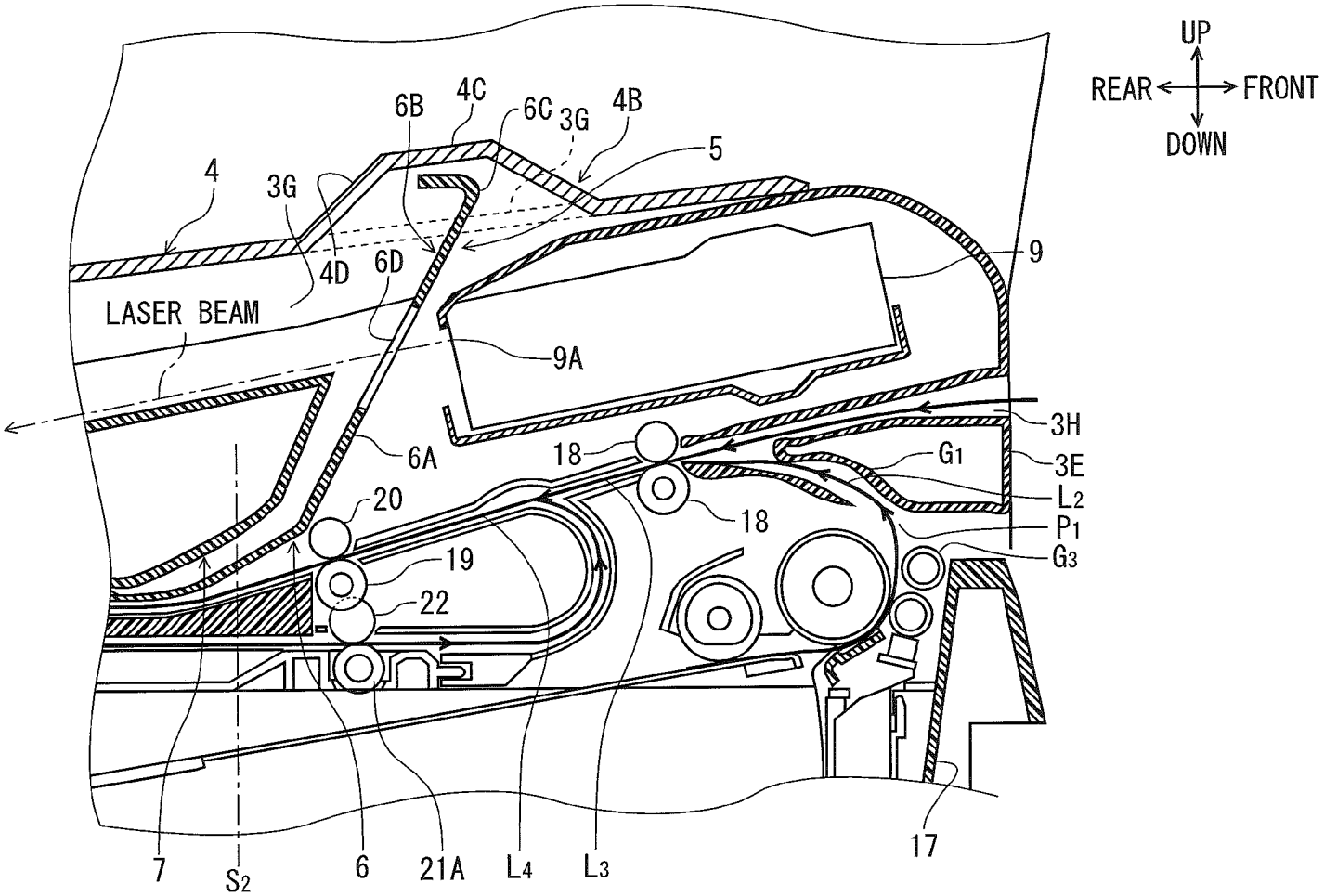
FIG. 4 is a diagram illustrating the registration driving roller, the re-conveying roller, and other components which are projected onto a first virtual plane.

As illustrated in FIG. 4, the re-conveying roller 22 is located closer to the turning apex P1 than the photosensitive drum 8 in the horizontal direction. The re-conveying roller 22 is rotatably attached to the apparatus body. The re-conveying roller 22 rotates to follow the conveyance of the sheet conveyed through the second re-conveying path L52.

A second re-conveying roller 21A is disposed at a position of the re-conveying unit 21 facing the re-conveying roller 22. The second re-conveying roller 21A rotates while coming in contact with the sheet conveyed through the second re-conveying path L52.

Figure 5:
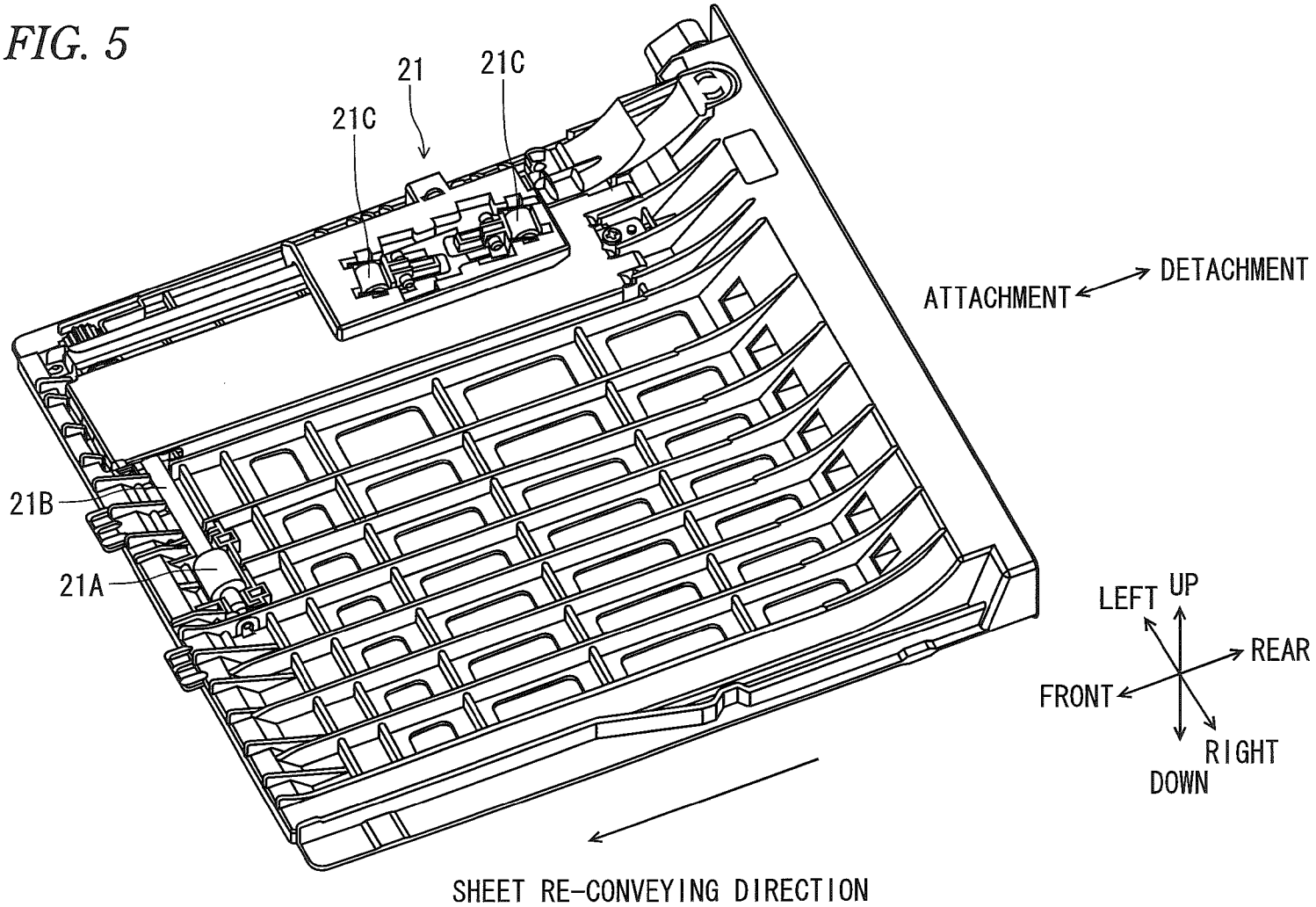
FIG. 5 is a perspective view of a re-conveying unit.

As illustrated in FIG. 5, the second re-conveying roller 21A rotates with the driving force from the driving shaft 21B. A third re-conveying roller 21C constitutes a correcting mechanism that corrects oblique conveyance of a sheet by bringing one end thereof in the width direction into contact with the sheet conveyed through the re-conveying unit 21.

Figure 6:
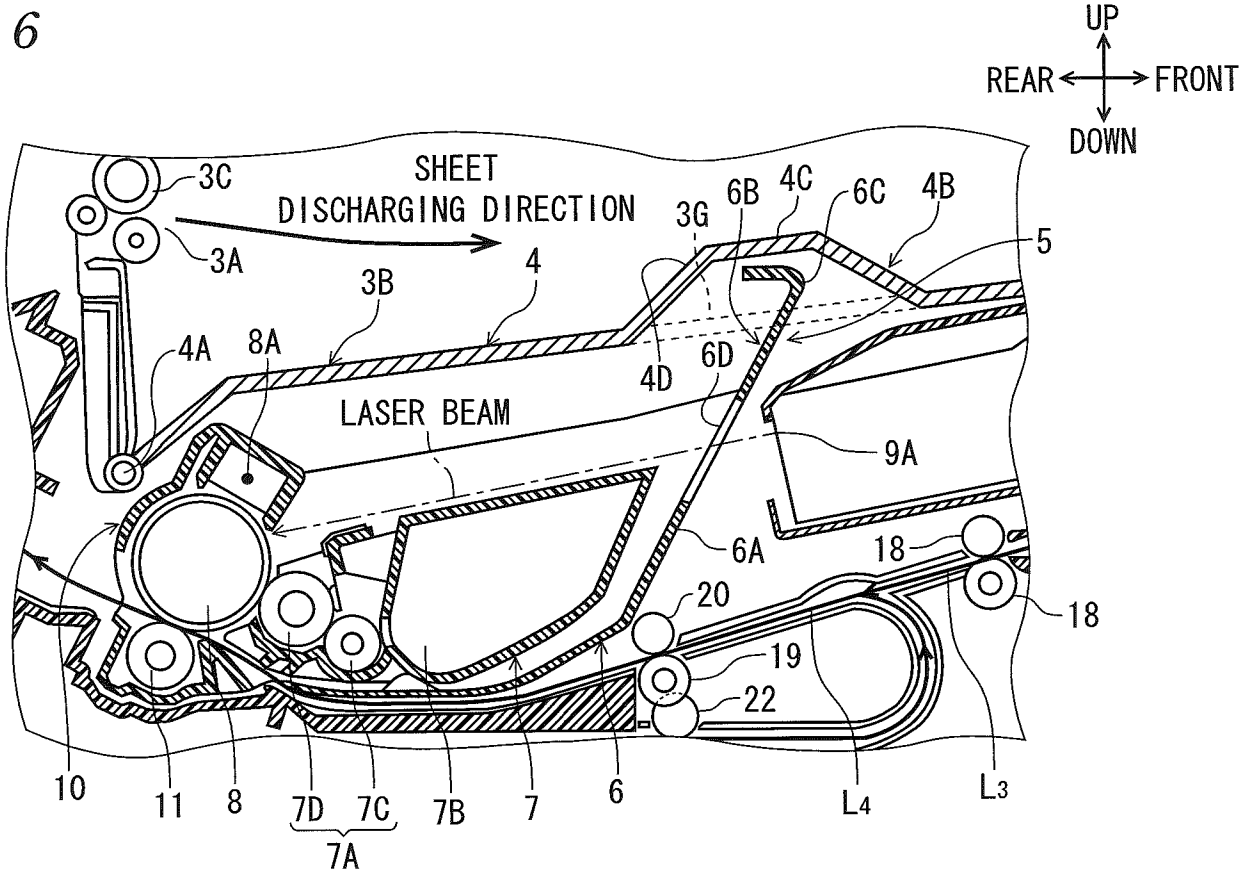
FIG. 6 is an enlarged view of a part including an image forming unit of the image forming apparatus shown in FIG. 1.

As illustrated in FIG. 6, a handle 6B is formed in the image forming unit 6. The handle 6B is a part which is gripped by a user at the time of detachment of the image forming unit 6. In this embodiment, the handle 6B is formed in the support member 6A.

At least a part of the handle 6B protrudes upward in the vertical direction from the opening 3G in a state in which the image forming unit 6 is attached to the apparatus body. Hereinafter, a part of the handle 6B protruding from the opening 3G is referred to as a handle tip 6C.

The expression, "the handle tip 6C protrudes from the opening 3G," means a state in which the handle tip 6C penetrates the case 3 from inside to outside such that the handle tip 6C intersects the outer edge (the dotted line in FIG. 6) of the opening 3G.

A protruding lid 4B is disposed in the intermediate cover 4. The protruding lid 4B is a part that covers the handle tip 6C from the upside in the vertical direction when the intermediate cover 4 is located at the closed position. Accordingly, the protruding lid 4B projected onto the first virtual plane S1 and the handle tip 6C projected onto the first virtual plane S1 overlap with each other partially.

Figure 7:
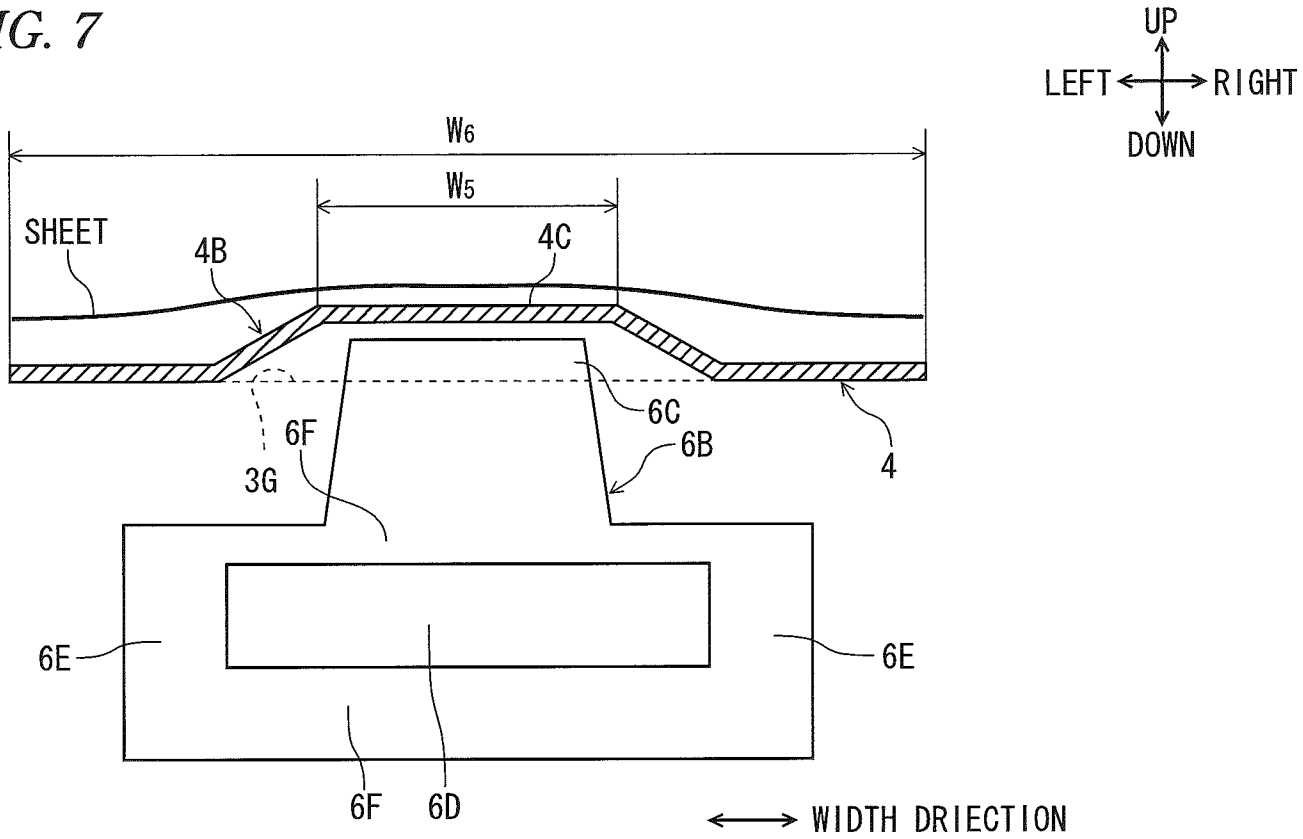
FIG. 7 is a diagram illustrating a handle and other components which are projected onto the second virtual plane.

The protruding lid 4B is a part in which a part of the intermediate cover 4 protrudes upward in the vertical direction as illustrated in FIG. 7. The part of the intermediate cover 4 in which the protruding lid 4B is disposed is a part constituting a part of the sheet discharging tray 3B and is located substantially at the center in the width direction of the intermediate cover 4.

Accordingly, the sheet discharged to the sheet discharging tray 3B is placed on the sheet discharging tray 3B in a state in which the sheet is curved to be convex in the same direction as the protruding direction of the protruding lid 4B. The width direction is parallel to the axial direction. The width direction in this embodiment is parallel to the right-left direction.

The outer edge of the protruding lid 4B has a shape like a parallelepiped shape. That is, a ridge 4C in which the tip in the protruding direction of the protruding lid 4B is arranged extends in the width direction and the length W5 in the extending direction of the ridge 4C is smaller than the length W6 in the width direction of the intermediate cover 4.

Figure 8:
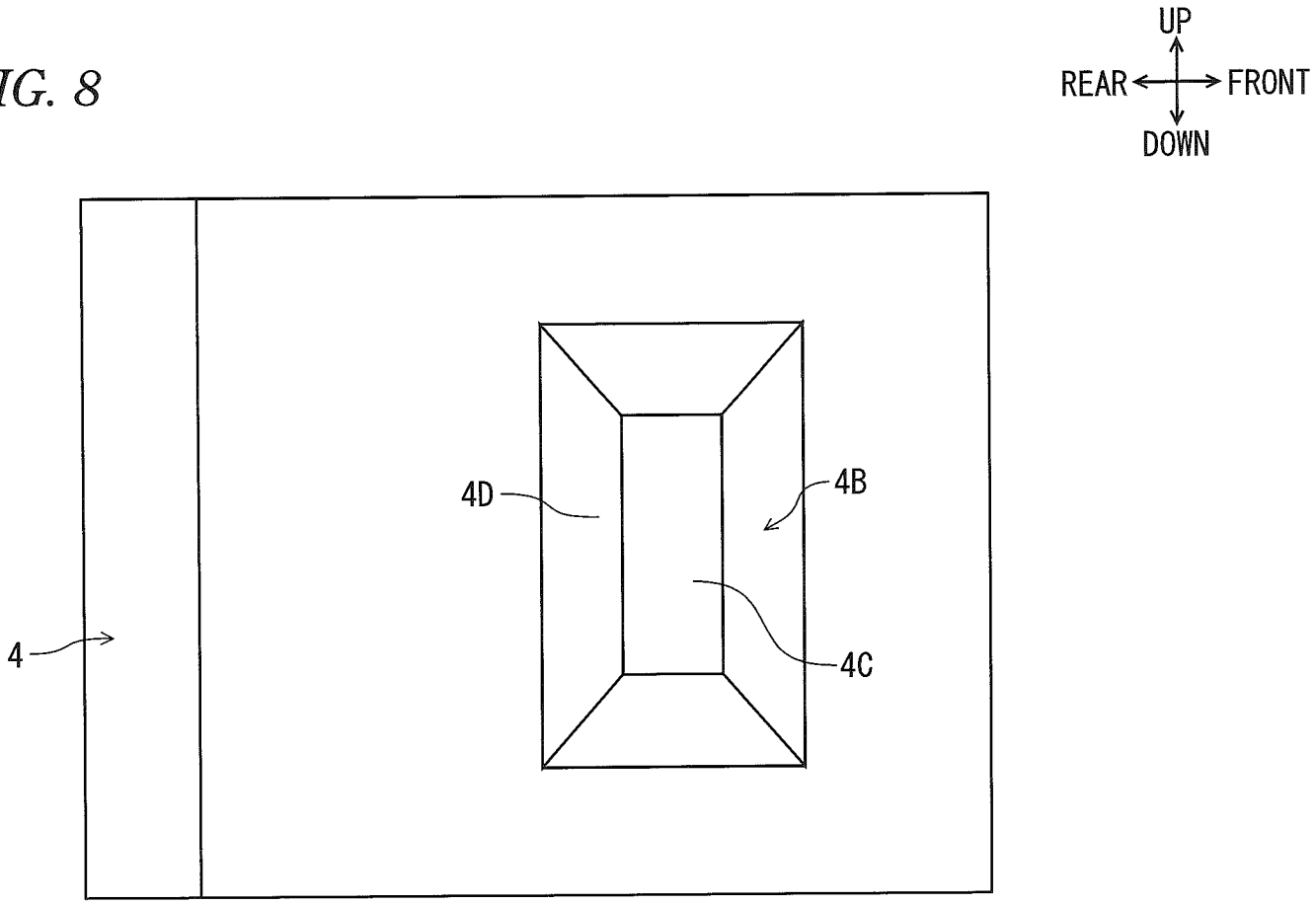
FIG. 8 is a top view of an intermediate cover.

As illustrated in FIG. 8, a inclined path 4D is formed on at least the sheet discharging port 3A side (the rear side in this embodiment) of the protruding lid 4B. The inclined path 4 is inclined with respect to the sheet discharging direction so as to have a higher height in the vertical direction at a position further from the sheet discharging port 3A in the horizontal direction as illustrated in FIG. 1.

The handle 6B is located between the exposure device 9 and the photosensitive drum 8. That is, the exposure device 9 is disposed on the opposite side of the handle 6B to the photosensitive drum 8. A window portion 6D is formed in a part of the handle 6B corresponding to a light-emitting portion 9A of the exposure device 9 as illustrated in FIG. 6.

The window portion 6D is a part through which exposure light emitted from the exposure device 9 can pass. The window portion 6D in this embodiment is formed as a through-hole penetrating the handle 6B. The window portion 6D can be formed even by disposing a transparent member capable of transmitting light in the through-hole (the window portion 6D).

As illustrated in FIG. 7, first frame portions 6E surrounding both sides in the width direction of the window portion 6D are disposed on both sides in the width direction of the handle 6B with the window portion 6D interposed therebetween. Second frame portions 6F surround both sides in the vertical direction of the window portion 6D are disposed on both sides of the handle 6B in the vertical direction with the window portion 6D interposed therebetween.

The handle tip 6C is disposed in a part located above the pair of second frame portions 6F in the vertical direction. In this embodiment, the pair of first frame portions 6E, the pair of second frame portions 6F, the handle tip 6C, and the like are formed as a unified body out of a resin along with the support member 6A.

In this embodiment, the registration driving roller 19 projected onto the first virtual plane S1 perpendicular to the axial direction and the re-conveying roller 22 projected onto the first virtual plane S1 overlap with each other at least partially. Accordingly, in comparison with an image forming apparatus in which two kinds of rollers 19 and 22 projected onto the first virtual plane S1 do not overlap with each other, it is possible to reduce the external dimensions of the image forming apparatus.

In this embodiment, the conveying roller portions 19A projected onto the second virtual plane S2 are located on both sides of the re-conveying roller portion 22A projected onto the second virtual plane S2. Accordingly, it is possible to prevent a sheet from being obliquely conveyed in a state in which the sheet is inclined with respect to the conveying direction.

In this embodiment, in a state in which the intermediate cover 4 is located at the opened position, a part of the handle 6B, that is, the handle tip 6C, protrudes from the opening 3G. Accordingly, a user can visually recognize the handle 6B. As a result, it is possible to improve detachment workability of the image forming unit 6.

In this embodiment, the protruding lid 4B is disposed in the sheet discharging tray 3B of the intermediate cover 4. Accordingly, even when a sheet "is cylindrically curled," the cylindrically-curled sheet can be corrected. The expression, the sheet "is cylindrically curled," means a state in which the sheet is cylindrically curved such that both ends in the width direction of the sheet are located in the same direction as the protruding direction of the protruding lid 4B.

In this embodiment, the protruding lid 4B is located at the center in the axial direction of the sheet discharging tray 3B. Accordingly, it is possible to satisfactorily correct the cylindrically-curled sheet.

In this embodiment, the protruding lid 4B is located at the center in the axial direction of the sheet discharging tray 3B. Accordingly, as illustrated in FIG. 7, a gap is formed between both ends in the width direction of the sheet and the sheet discharging tray 3B. A user can easily grip the sheet discharged to the sheet discharging tray 3B by inserting a finger into the gap, and it is thus possible to improve operability by the user.

The image forming unit 6 according to the above-mentioned embodiment has the container unit 7 and the drum unit 10 being combined as a unified body, but the present disclosure is not limited to this configuration. For example, the container unit 7 and the drum unit 10 may be configured separately. In this case, the handle tip 6C of the handle 6B may be disposed in at least one of the container unit 7 and the drum unit 10.

In the above-mentioned embodiment, two conveying roller portions 19A are disposed and one re-conveying roller portion 22A is disposed, but the present disclosure is not limited to this configuration. The re-conveying unit 21 in the above-mentioned embodiment can be attached to and detached from the apparatus body, but the present disclosure is not limited to this configuration. For example, the re-conveying unit 21 may be attached to the apparatus body so as not to be detachable therefrom.

In the above-mentioned embodiment, the image forming unit 6 is attached and detached through the opening 3C, but the present disclosure is not limited to this configuration. For example, the image forming unit 6 may be attached and detached through the front side.

In the above-mentioned embodiment, the handle 6B is disposed in the image forming unit 6 and the protruding lid 4B covering the handle tip 6C is disposed in the intermediate cover 4, but the present disclosure is not limited to this configuration. For example, the handle 6B and the protruding lid 4B may be removed.

In the protruding lid 4B in the above-mentioned embodiment, the inclined path 4D is formed on the sheet discharging port 3A side, but the present disclosure is not limited to this configuration. For example, the inclined path 4D may be removed.

In the above-mentioned embodiment, the intermediate cover 4 also serves as the sheet discharging tray 3B, but the present disclosure is not limited to this configuration. For example, the intermediate cover 4 and the sheet discharging tray 3B may be independently disposed.

In the above-mentioned embodiment, the window portion 6D is formed in the handle 6B, but the present disclosure is not limited to this configuration. For example, the exposure device 9 may be disposed so as to set an optical path at a position other than the handle 6B.

In the above-mentioned embodiment, the image forming apparatus according to the present disclosure is applied to a monochrome printer, but the present disclosure is not limited to the monochrome printer. For example, the present disclosure can be applied to a color printer.

What is claimed is:

1. An image forming apparatus comprising:

an image forming section that forms an image on a sheet in an electrophotographic method;

a sheet feeding tray on which a sheet to be conveyed to the image forming section is placed;

a conveying roller that conveys the sheet to the image forming section;

a sheet discharging tray to which the sheet being formed with an image by the image forming section is discharged;

a sheet discharging roller that is switched between a first state in which the sheet discharging roller rotates in a first direction in which the sheet is discharged to the sheet discharging tray and a second state in which the sheet discharging roller rotates in a second direction in which the sheet is conveyed back toward the image forming section; and a re-conveying roller that conveys the sheet conveyed back toward the image forming section by the sheet discharging roller, the re-conveying roller having an axial direction parallel to an axial direction of the conveying roller and being located at a position at which the re-conveying roller physically overlaps with the conveying roller in the axial direction of the conveying roller.

2. The image forming apparatus according to claim 1, wherein when a portion of the conveying roller which rotates while being in contact with a sheet is defined as a conveying roller portion, and a portion of the re-conveying roller which rotates while being in contact with a sheet is defined as a re-conveying roller portion, the conveying roller portion is displaced with respect to the re-conveying roller portion in the axial direction.

3. The image forming apparatus according to claim 2, wherein the conveying roller includes: at least one of the conveying roller portion; and a conveying roller shaft that supports the conveying roller portion and has a diameter smaller than that of the conveying roller portion, wherein the re-conveying roller includes: at least one of the re-conveying roller portion; and a re-conveying roller shaft that supports the re-conveying roller portion and has a diameter smaller than that of the re-conveying roller portion, wherein the size in the axial direction of the conveying roller portion is smaller than the size in the axial direction of the conveying roller shaft, and wherein the size in the axial direction of the re-conveying roller portion is smaller than the size in the axial direction of the re-conveying roller shaft.

4. The image forming apparatus according to claim 2, wherein the conveying roller includes at least two of the conveying roller portions, and wherein the conveying roller portions projected, in the axial direction, onto a virtual plane perpendicular to the axial direction of the conveying roller are located on both sides of the re-conveying roller portion projected, in the axial direction, onto the virtual plane.

5. The image forming apparatus according to claim 1 further comprising:

a re-conveying unit that includes a re-conveying path for guiding the sheet from the sheet discharging roller to the image forming section, the re-conveying unit being configured to be detachable from an apparatus body; and a second re-conveying roller that is disposed in the re-conveying unit at a position facing the re-conveying roller, the second re-conveying roller being configured to rotate while being in contact with a sheet conveyed through the re-conveying path.

6. The image forming apparatus according to claim 1, wherein the image forming section includes a photosensitive drum that holds a developer image, wherein the photosensitive drum is disposed at a position above the sheet feeding tray in the vertical direction, wherein the image forming apparatus further comprises:

a first conveyance guide portion that serves as a U-shaped conveying path for guiding the sheet from the sheet feeding tray to the photosensitive drum, the first conveyance guide portion being configured to turn around a conveying direction of the sheet, wherein the U-shaped conveying path includes a post-turning conveying path in which a leading side in the conveying direction is directed to the photosensitive drum, the post-turning conveying path including an inclined path that descends in the vertical direction toward the photosensitive drum, and wherein the conveying roller is disposed at a position along the inclined path.

7. The image forming apparatus according to claim 6, wherein the sheet conveyed by the re-conveying roller arrives at the image forming section through at least a part of the post-turning conveying path.

8. The image forming apparatus according to claim 6, wherein the image forming section includes a fixing device that fixes a developer that is transferred onto a sheet, wherein a contact part of the fixing device and the sheet is located above a contact part of the photosensitive drum and the sheet in the vertical direction, and wherein the image forming apparatus further comprises a second conveyance guide portion that serves as a sheet conveying path that extends from the photosensitive drum to the fixing device and is inclined with respect to the horizontal direction.

9. The image forming apparatus according to claims 6, wherein the U-shaped conveying path includes a turning apex at which the conveying direction matches the vertical direction, and wherein the re-conveying roller is located closer to the turning apex than the photosensitive drum in the horizontal direction.

10. The image forming apparatus according to claim 1, wherein the conveying roller serves as a driving conveying roller that applies a conveying force to the sheet, and wherein the re-conveying roller serves as a follower roller that rotates to follow the sheet as the sheet is conveyed.

11. The image forming apparatus according to claim 1, wherein the conveying roller serves as a part of a correcting mechanism that corrects a position of the conveyed sheet.

* * * * *